US009166296B2

(12) United States Patent
Huang et al.

(10) Patent No.: US 9,166,296 B2
(45) Date of Patent: Oct. 20, 2015

(54) LOOP-TYPE ANTENNA

(75) Inventors: Chih-Yung Huang, Taichung County (TW); Kuo-Chang Lo, Miaoli County (TW)

(73) Assignee: Arcadyan Technology Corporation, Hsinchu (TW)

( * ) Notice: Subject to any disclaimer, the term of this patent is extended or adjusted under 35 U.S.C. 154(b) by 479 days.

(21) Appl. No.: 13/185,633

(22) Filed: Jul. 19, 2011

(65) Prior Publication Data

US 2012/0081261 A1 Apr. 5, 2012

(30) Foreign Application Priority Data

Sep. 30, 2010 (TW) ..... 99133365 A

(51) Int. Cl.
*H01Q 7/00* (2006.01)
*H01Q 9/42* (2006.01)
*H01Q 21/28* (2006.01)

(52) U.S. Cl.
CPC . *H01Q 9/42* (2013.01); *H01Q 7/00* (2013.01); *H01Q 21/28* (2013.01)

(58) Field of Classification Search
CPC ..... H01Q 7/00; H01Q 9/42; H01Q 11/20
USPC ..... 343/866
See application file for complete search history.

(56) References Cited

U.S. PATENT DOCUMENTS 5,680,144 A * 10/1997 Sanad ..... 343/700 MS
6,075,493 A * 6/2000 Sugawara et al. ..... 343/767
6,819,290 B2 * 11/2004 Hani et al. ..... 343/700 MS
6,853,341 B1 * 2/2005 Hellgren et al. ..... 343/742
7,102,572 B2 9/2006 Okado
7,576,698 B2 * 8/2009 Cheng ..... 343/700 MS
2008/0158851 A1 * 7/2008 Cochrane ..... 361/818
2008/0231530 A1 * 9/2008 Rao et al. ..... 343/767
2009/0128416 A1 5/2009 Cheng
2010/0079351 A1 * 4/2010 Huang et al. ..... 343/846

FOREIGN PATENT DOCUMENTS

TW I 319643 3/2008

OTHER PUBLICATIONS

Taiwanese Office Action for Corresponding TW application No. 099133365 filed Sep. 30, 2010.
Office Action for Corresponding PRC Application Dated Apr. 14, 2014.

* cited by examiner

*Primary Examiner* — Hoang V Nguyen
*Assistant Examiner* — Michael Bouizza
(74) *Attorney, Agent, or Firm* — Gottlieb, Rackman & Reisman P.C.

(57) ABSTRACT

An antenna interacting with a signal having a frequency is provided. The antenna includes a radiation element having a hollow portion having an angle corner related to the frequency, and including a first inner edge; a second inner edge, wherein the angle corner is formed by the first inner edge and the second inner edge; a third inner edge connected to the second inner edge; a first outer edge; and a second outer edge, wherein the first outer edge and the second outer edge form a first included angle.

17 Claims, 14 Drawing Sheets

LOOP-TYPE ANTENNA

CROSS-REFERENCE TO RELATED APPLICATION AND CLAIM OF PRIORITY

The application claims the benefit of Taiwan Patent Application No. 099133365, filed on Sep. 30, 2010, in the Taiwan Intellectual Property Office, the disclosures of which are incorporated herein in their entirety by reference.

FIELD OF THE INVENTION

The present invention relates to an antenna, and more particularly to a loop-type antenna.

BACKGROUND OF THE INVENTION

The antenna is a converting device designed for sending or receiving the electromagnetic wave, which can convert the electromagnetic wave into the current, and vice versa. The voltage standing wave ratio (VSWR) of the antenna is commonly used to estimate the matching status between the impedance value of the transmission wire and that of the antenna. It is well-known by the skilled person that $VSWR=V_{max}/V_{min}=(1+|\Gamma|)/(1-|\Gamma|)$, wherein $V_{max}$ represents the maximum voltage value of the standing wave, $V_{min}$ represents the minimum voltage value of the standing wave, and $\Gamma$ represents the reflection coefficient. It is also well-known by the skilled person that $\Gamma=(Z-Z0)/(Z+Z0)$, wherein Z is the impedance value of the antenna, and Z0 is the impedance value of the transmission wire. Therefore, the impedance value of the antenna Z will affect the reflection coefficient, thereby indirectly affecting the VSWR, i.e. the matching status between the impedance value of the transmission wire and that of the antenna. Hence, the impedance value of the antenna needs to be considered when designing the antenna. When designing the antenna, the receiving or transmitting frequency of the antenna, the gain of the antenna, the radiation power of the antenna, the return loss of the antenna, the length and geometric figure of the antenna, and the matching between the impedance value of the transmission wire and the impedance value of the antenna also need to be considered.

Currently, the size of the wireless product tends to miniaturization. The antenna is an important element of the wireless product so that it also tends to miniaturization.

Please refer to FIG. 1, which shows a conventional dual-band loop-type antenna in the Taiwanese Patent No. I319643. The conventional dual-band loop-type antenna 1 includes a ground surface 11, an FR4 glass substrate 10, a radiation metal ring 12 and a radiation metal sheet 13. The ground surface 11 includes a ground point 111 and a short-circuit point 112. The radiation metal ring 12 has a feed terminal 121 and a short-circuit terminal 122, and there is a specific distance between the feed terminal 121 and the short-circuit terminal 122. The short-circuit terminal 122 is electrically connected to the short-circuit point 112 on the ground surface 11, and the specific distance between the feed terminal 121 and the short-circuit terminal 122 is less than 5 mm. The radiation metal sheet 13 has a terminal 131, and is surrounded by the radiation metal ring 12. The terminal 131 of the radiation metal sheet 13 is electrically connected to the vicinity of the short-circuit terminal 122 of the radiation metal ring 12, and the distance between the terminal 131 and the short-circuit terminal 122 is less than 10 mm.

The size of the ground surface 11 is 50*100 $mm^2$, and the area surrounded by the radiation metal ring 12 is 50*15 $mm^2$.

Since the conventional dual-band loop-type antenna 1 occupies more space, it is not suitable for the small wireless product. Besides, the conventional dual-band loop-type antenna 1 has a small bandwidth, and is only suitable for the central frequency 900 MHz with a bandwidth of 250 MHz as well as the central frequency 1800 MHz with a bandwidth of 170 MHz. Moreover, the conventional dual-band loop-type antenna 1 uses the printed circuit board and the etching technology to be formed, together with the ground surface 1, on the FR4 glass substrate 10 with a thickness of 0.8 mm. This not only requires a more complicated process and a higher cost, but also reduces the radiation power of the antenna.

In order to overcome the drawbacks in the prior art, a loop-type antenna is provided. The particular design in the present invention not only solves the problems described above, but also is easy to be implemented. Thus, the present invention has the utility for the industry.

SUMMARY OF THE INVENTION

In accordance with an aspect of the present invention, an antenna is provided. The antenna is suitable for the wireless transmission device, and can be easily adjusted according to the requirements of the device to achieve a desirable frequency. The desirable frequency approximately ranges between 4.8 GHz and 6 GHz. The antenna can be applied to the notebook computer, the cellphone, the access point (AP), or the wireless transmission TV or DVD. The antenna can also be applied to the wireless device using the 802.11/a transmission, the WIFI transmission, the 3G transmission, the 3.5G transmission or the 4G transmission.

In accordance with another aspect of the present invention, an antenna is provided. The antenna includes a first antenna unit having a first impedance value and including a first radiation element having an edge and a first hollow portion having a first angle corner; a first ground portion connected to the first radiation element; and a first feed portion connected to the first radiation element and having an edge, wherein the edge of the first feed portion and the edge of the first radiation element form a first included angle; and a second antenna unit having a second impedance value and including a second radiation element having an edge and a second hollow portion having a second angle corner; a second ground portion connected to the second radiation element; and a second feed portion connected to the second radiation element and having an edge, wherein the edge of the second feed portion and the edge of the second radiation element form a second included angle, wherein the first ground portion is connected to the second ground portion, the first impedance value is set by the first angle corner, and the second impedance value is set by the second angle corner.

In accordance with a further aspect of the present invention, an antenna interacting with a signal having a frequency is provided. The antenna includes a radiation element having a hollow portion having an angle corner related to the frequency, and including a first inner edge; a second inner edge, wherein the angle corner is formed by the first inner edge and the second inner edge; a third inner edge connected to the second inner edge; a first outer edge; and a second outer edge, wherein the first outer edge and the second outer edge form a first included angle.

In accordance with further another aspect of the present invention, an antenna having an impedance value is provided. The antenna includes a radiation element having a hollow portion having an angle corner related to the impedance value, and including a first inner edge; a second inner edge, wherein the angle corner is formed by the first inner edge and the second inner edge; a third inner edge connected to the second inner edge; a first outer edge; and a second outer edge, wherein the first outer edge and the second outer edge form a first included angle.

The above objects and advantages of the present invention will become more readily apparent to those ordinarily skilled in the art after reviewing the following detailed descriptions and accompanying drawings, in which:

BRIEF DESCRIPTION OF THE DRAWINGS

FIG. 2(*b*) is an isogonal view of the antenna according to the first embodiment of the present invention;

FIG. 2(*c*) shows the antenna with the angle θ of 180° according to the first embodiment of the present invention;

FIG. 2(*d*) shows the antenna with the angle θ between 0° and 180° according to the first embodiment of the present invention;

FIG. 2(*e*) shows the antenna with the angle θ of 0° according to the first embodiment of the present invention;

FIG. 4(*b*) is the radiation pattern of the antenna operating at the frequency f1 of 4.9 GHz in the Z-X plane according to the first embodiment of the present invention;

FIG. 4(*c*) is the radiation pattern of the antenna operating at the frequency f1 of 4.9 GHz in the X-Y plane according to the first embodiment of the present invention;

FIG. 4(*d*) is the radiation pattern of the antenna operating at the frequency f1 of 5.875 GHz in the Y-Z plane according to the first embodiment of the present invention;

FIG. 4(*e*) is the radiation pattern of the antenna operating at the frequency f1 of 5.875 GHz in the Z-X plane according to the first embodiment of the present invention;

FIG. 4(*f*) is the radiation pattern of the antenna operating at the frequency f1 of 5.875 GHz in the X-Y plane according to the first embodiment of the present invention;

FIG. 6(*b*) shows the antenna connected to a substrate in parallel according to the first embodiment of the present invention.

DETAILED DESCRIPTION OF THE PREFERRED EMBODIMENT

Figure 1:
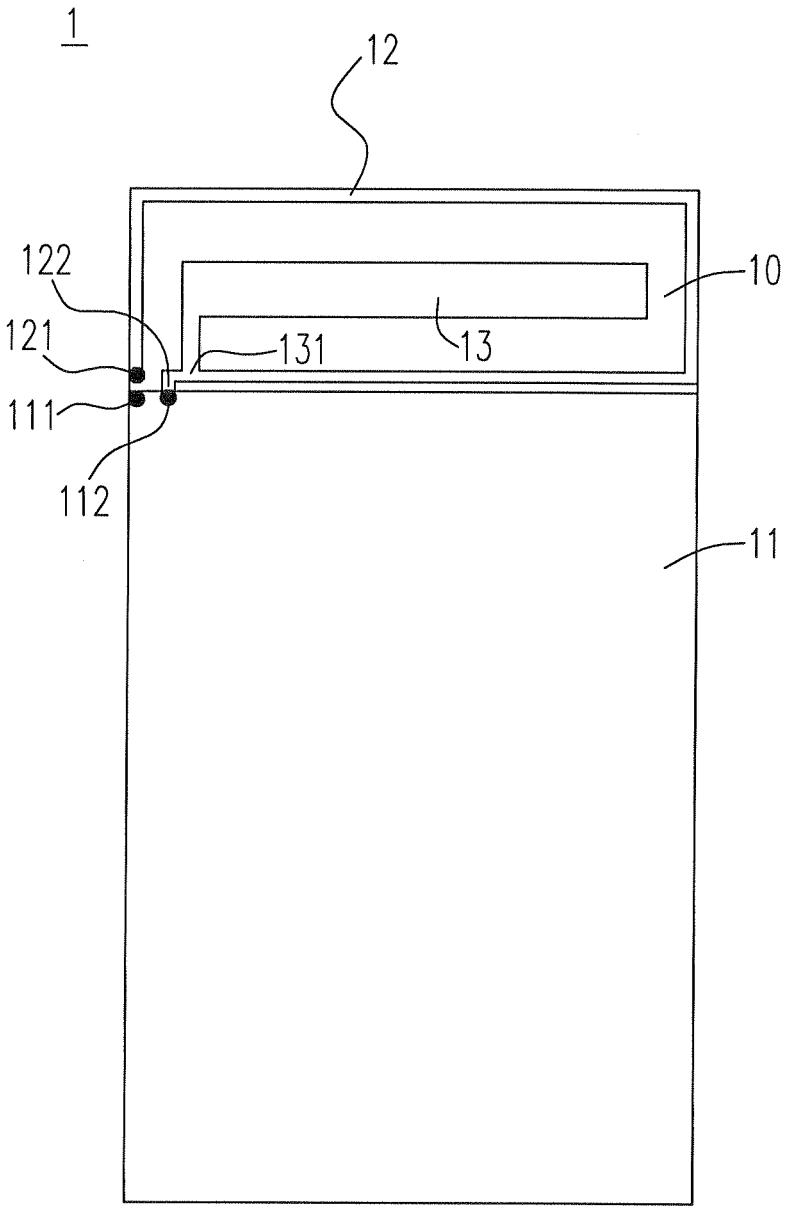
Fig. 1(Prior Art)
FIG. 1 shows a conventional dual-band loop-type antenna.
Figure 2A:
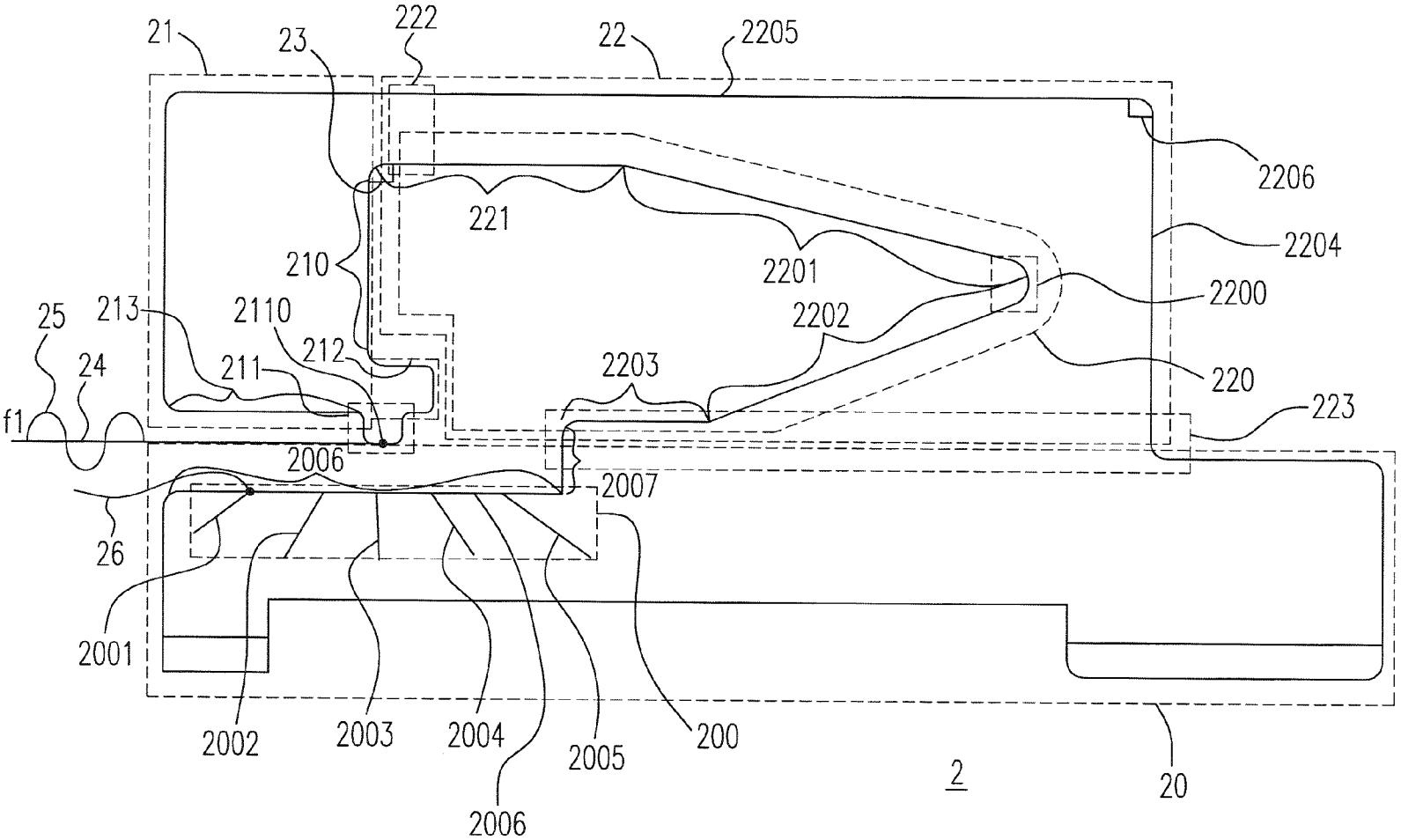
FIG. 2(*a*) shows an antenna according to a first embodiment of the present invention.
Figure 2B:
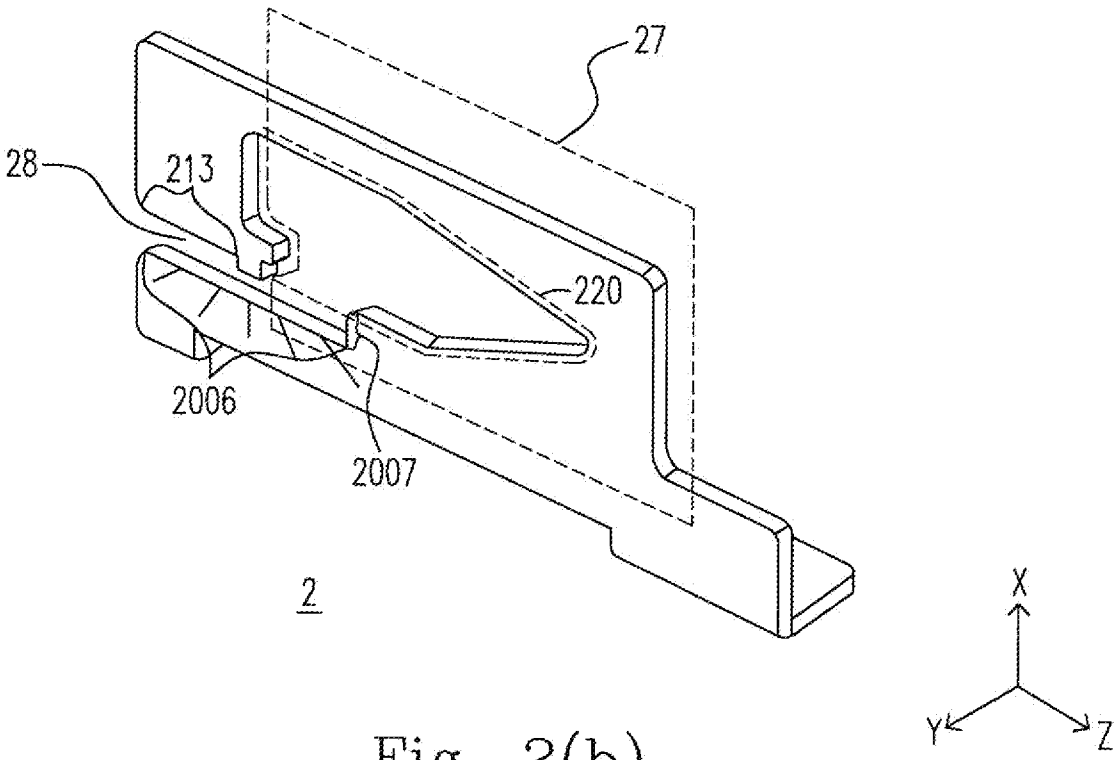
Figure 2C:
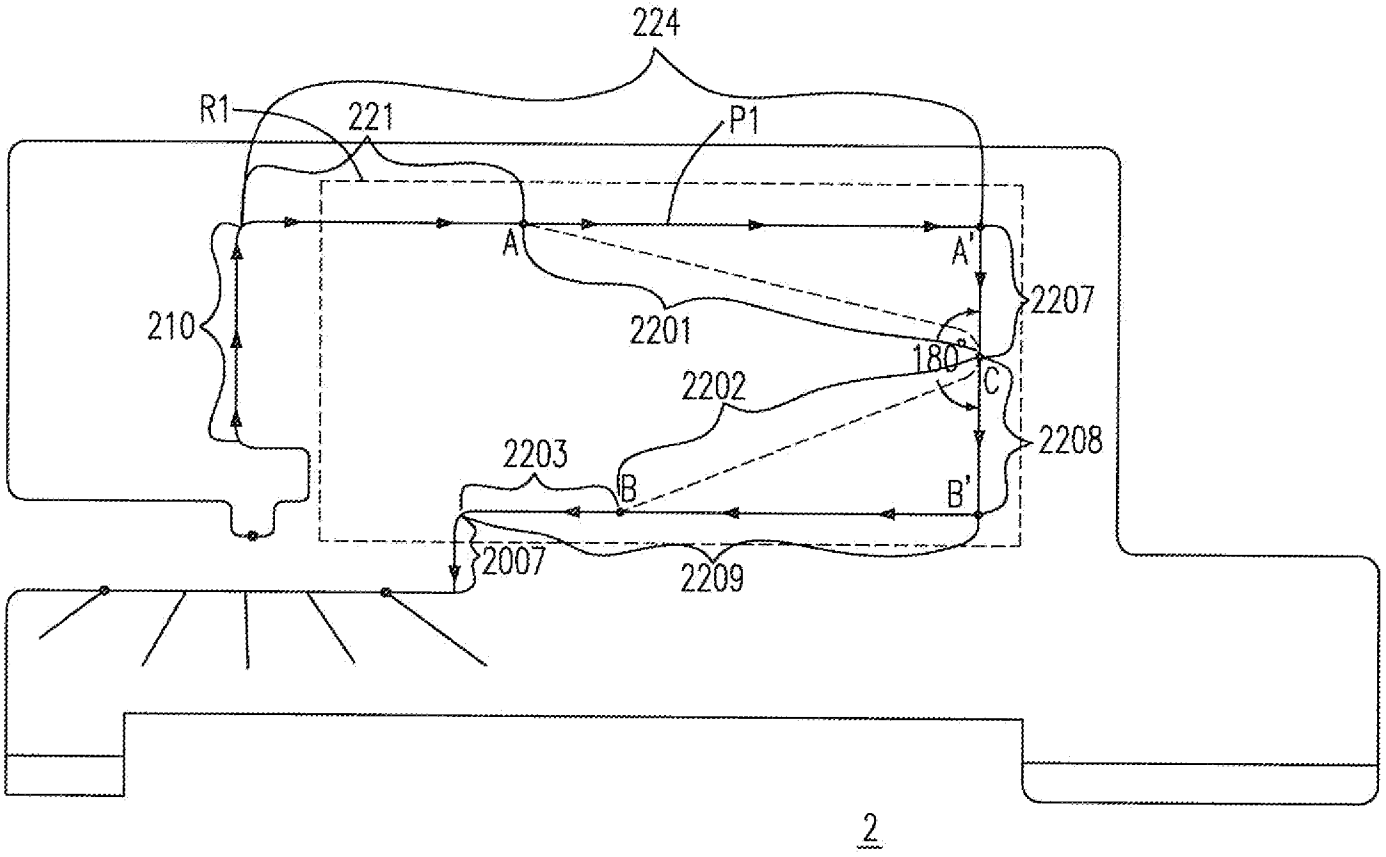
Figure 2D:
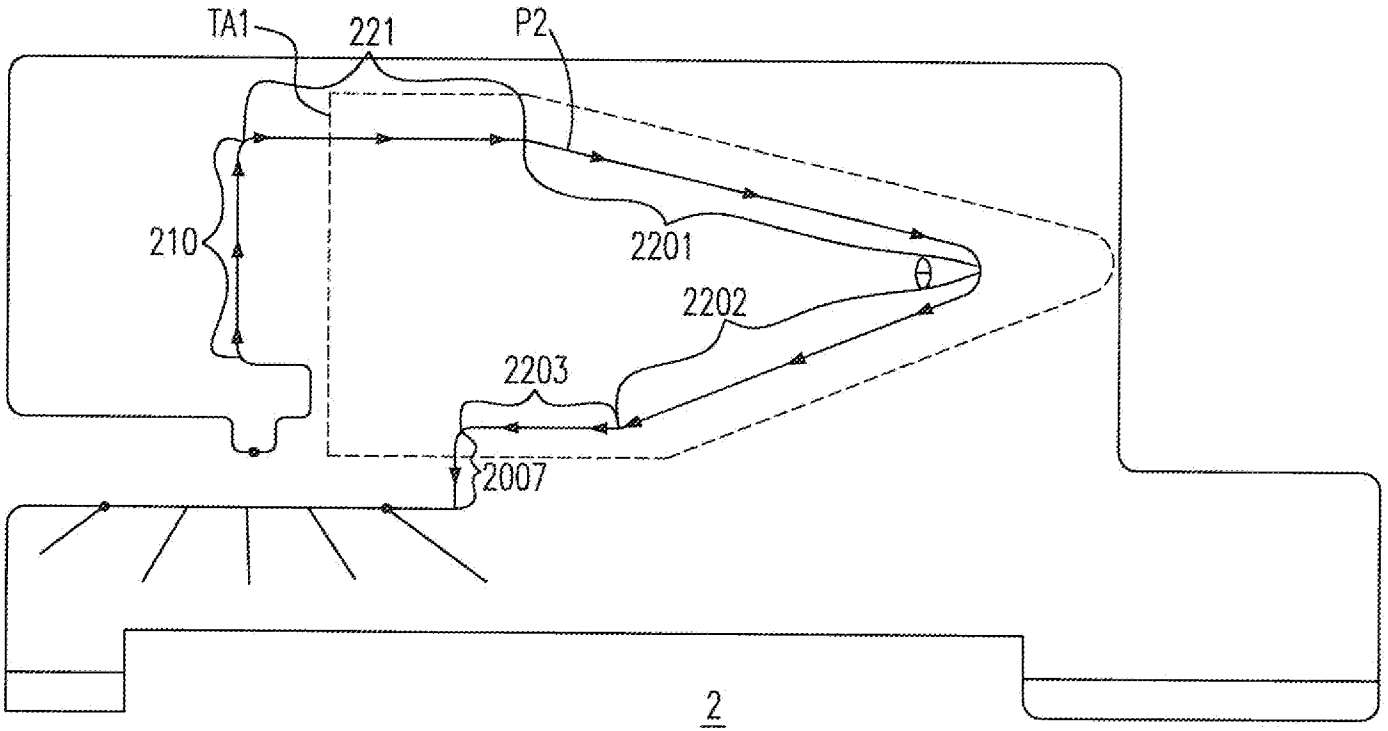
Figure 2E:
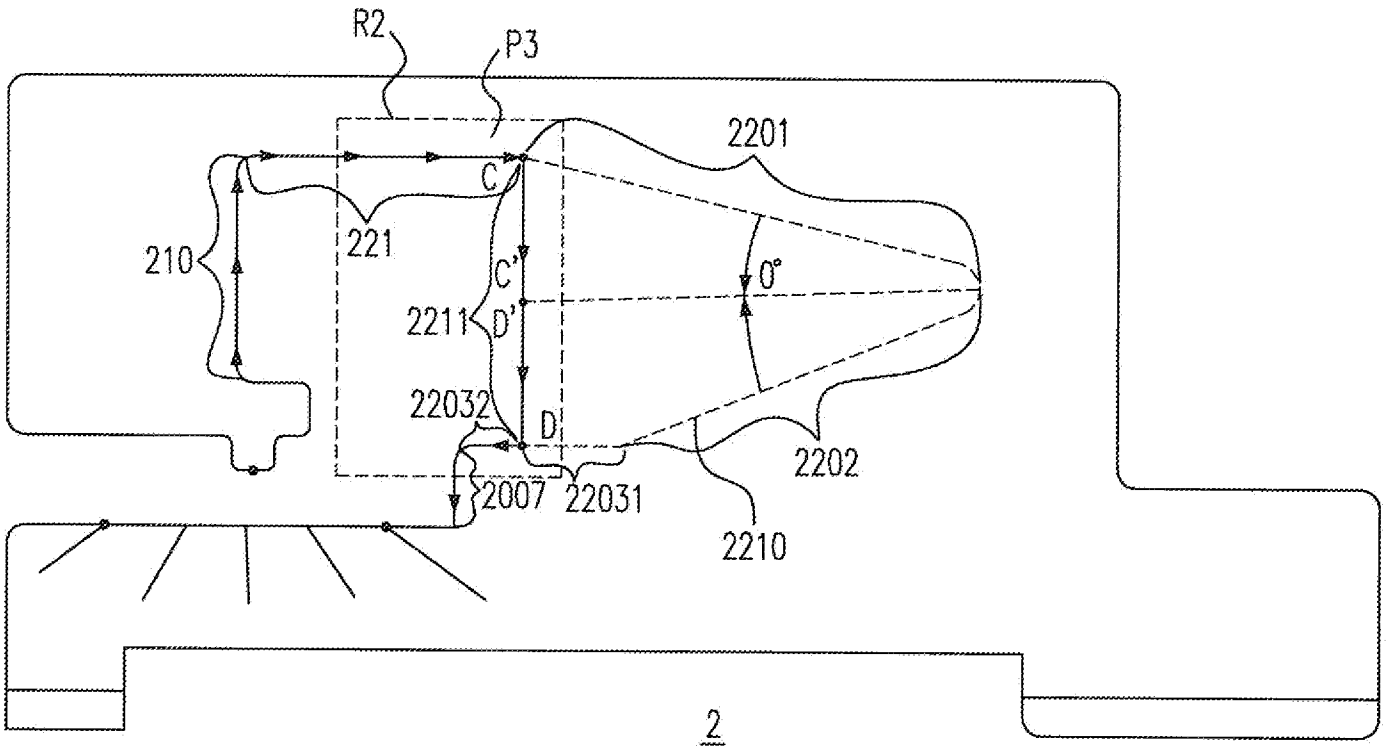

The present invention will now be described more specifically with reference to the following embodiments. It is to be noted that the following descriptions of preferred embodiments of this invention are presented herein for the purposes of illustration and description only; it is not intended to be exhaustive or to be limited to the precise form disclosed.

Please refer to FIG. 2(*a*), which shows an antenna according to a first embodiment of the present invention. The antenna 2 includes a radiation element 22, a ground portion 20, a feed portion 21, a transmission wire 24 and a conducting wire 26. A signal 25 having a frequency f1 is input to the transmission wire 24, and the transmission wire 24 is connected to a feed point 2110. The antenna 2 interacts with the signal 25 having the frequency f1. The radiation element 22 has a hollow portion 220, and the hollow portion 220 has an angle corner 2200 related to the frequency f1. The radiation element 22 includes a first inner edge 2201, a second inner edge 2202, a third inner edge 2203, a first outer edge 2204, a second outer edge 2205 and an inner edge 221. The first inner edge 2201 and the second inner edge 2202 form the angle corner 2200. The third inner edge 2203 is connected to the ground portion 20. The first outer edge 2204 and the second outer edge 2205 form a first included angle 2206.

The outer edge of the hollow portion 220 includes the inner edge 221, the first inner edge 2201, the second inner edge 2202 and the third inner edge 2203. The connection of the first inner edge 2201, the second inner edge 2202, the third inner edge 2203, the first outer edge 2204, the second outer edge 2205 and the inner edge 221 forms the non-hollow portion of the radiation element 2.

The radiation element 22 further includes a first end portion 222 and a second end portion 223. The feed portion 21 is connected to the first end portion 222 of the radiation element 22. The edge 210 of the feed portion 21 and the inner edge 221 of the radiation element 22 form a second included angle 23. The feed point 2110 receives the signal 25, and the second included angle 23 is 90°.

The ground portion 20 is connected to the second end portion 223 of the radiation element 22. The ground portion 20 has a plurality of recesses 200. The recesses 200 are disposed at different ground positions 2001, 2002, 2003, 2004, 2005 of the ground portion 20 for setting the characteristic length of the antenna 2 so as to enable the signal 25 having the frequency f1 to be sent or received by the antenna 2. The conducting wire 26 is connected to one of the different ground positions 2001, 2002, 2003, 2004, 2005 of the ground portion 20. The ground portion 20 further includes a third outer edge 2006 and a fourth outer edge 2007. The feed portion 21 further includes a fifth outer edge 213, a first protruding portion 211 and a second protruding portion 212. The feed point 2110 is located at the first protruding portion 211.

Please refer to FIG. 2(*b*), which is an isogonal view of the antenna according to the first embodiment of the present invention. The antenna 2 is substantially a sheet rectangle with a length of 24 mm and a width of 14 mm. Therefore, the antenna 2 of the present invention occupies less space than the conventional dual-band loop-type antenna 1. In FIG. 2(*b*), the respective directions of the X-axis, the Y-axis and the Z-axis are marked. The radiation element 22 has a sheet structure 27 being a V-shaped structure. The sheet structure 27 is made of metal. The antenna 2 is a rectangular loop-type structure 3 having a gap 28. The edge of the gap 28 includes the third outer edge 2006, the fourth outer edge 2007, the fifth outer edge 213 and the outer edge of the first protruding portion 211. The hollow portion 220 is connected to the gap 28 at the first protruding portion 211 and the fourth outer edge 2007.

Please refer to FIG. 2(*c*), which shows the antenna with the angle θ of 180° according to the first embodiment of the present invention. In the following embodiments, the ground position 2005 is used to describe how the characteristic length of the antenna 2 changes when the angle θ of the angle corner 2200 changes. In the first embodiment of the present invention, the angle θ is between 0° and 180°. In FIG. 2(*c*), when the angle θ is 180°, one end of the first inner edge 2201 moves from the point A to the point A', and the inner edge 221 of the radiation element 2 extends from the point A to the point A' to form an inner edge 224. Another end C of the first inner edge

2201 does not change, so that the first inner edge 2201 changes into an inner edge 2207. One end of the second inner edge 2202 moves from the point B to the point B', and the third inner edge 2203 extends from the point B to the point B' to form an inner edge 2209. Another end C of the second inner edge 2202 does not change, so that the second inner edge 2202 changes into an inner edge 2208. Accordingly, the angle θ formed by the inner edge 2207 and the inner edge 2208 is 180°.

The hollow portion 220 presents a first rectangle R1, and the antenna 2 has a first path P1. The first path P1 includes the edge 210 of the feed portion 21, the inner edge 224, the inner edge 2207, the inner edge 2208, the inner edge 2209 and the fourth outer edge 2007, wherein the length of the first path P1 is a first characteristic length L1. The antenna 4 with the angle θ of 180° has the first characteristic length L1.

Please refer to FIG. 2(*d*), which shows the antenna with the angle θ between 0° and 180° according to the first embodiment of the present invention. In FIG. 2(*d*), when the angle θ is between 0° and 180°, the hollow portion 220 presents a triangle TA1, and the antenna 2 has a second path P2. The second path P2 includes the edge 210 of the feed portion 21, the inner edge 221 of the radiation element 22, the first inner edge 2201, the second inner edge 2202, the third inner edge 2203 and the fourth outer edge 2007, wherein the length of the second path P2 is a second characteristic length L2. The antenna 4 with the angle θ between 0° and 180° has the second characteristic length L2.

Please refer to FIG. 2(*e*), which shows the antenna with the angle θ of 0° according to the first embodiment of the present invention. In FIG. 2(*e*), the third inner edge 2203 includes the inner edge 22031 and the inner edge 22032. When the angle θ is 0°, one end of the first inner edge 2201 moves from the point C to the point C', and one point of the inner edge 22031 moves from the point D to the point D', wherein the point C' overlaps the point D', and the portion of the triangle 2210 is filled to become solid so that an inner edge 2211 is formed. The hollow portion 220 presents a second rectangle R2, and the antenna 2 has a third path P3. The third path P3 includes the edge 210 of the feed portion 21, the inner edge 221 of the radiation element 22, the inner edge 2211, the inner edge 22032 and the fourth outer edge 2007, wherein the length of the third path P3 is a third characteristic length L3. The antenna 4 with the angle θ of 0° has the third characteristic length L3.

From FIGS. 2(*c*)-2(*e*), it is known that the first characteristic length L1 is longer than the second characteristic length L2, and the second characteristic length L2 is longer than the third characteristic length L3. When the length of the loop-type antenna is one-fourth of the wavelength of the electromagnetic wave of the antenna (λ/4), the antenna has a shorter length and a better converting efficiency during transmission and reception. Besides, from the equation $c=f*\lambda$, it is known that when the electromagnetic wave proceeds at a fixed velocity of light, the frequency is inversely proportional to the wavelength. Therefore, the antenna 2 having the first characteristic length L1 has a lowest transmission/reception frequency, the antenna 2 having the second characteristic length L2 has a medium transmission/reception frequency, and the antenna 2 having the third characteristic length L3 has a highest transmission/reception frequency. The first characteristic length L1 is about 4.7 cm, the third characteristic length L3 is about 1.9 cm, and the second characteristic length L2 is between 1.9 cm and 4.7 cm.

The angle θ of the antenna 2 can be set according to different product requirements to achieve the optimum impedance matching after the combination of the antenna 2 with the product. Through the use of the simulation software, the angle θ achieving a better impedance matching can be forecasted in advance. This saves unnecessary costs of production and experiment. Besides the first embodiment using the angle θ to set the characteristic length of the antenna 2, the characteristic of the antenna 2 can also be set through different ground positions 2001, 2002, 2003, 2004, 2005 of the ground portion 20.

Figure 3:
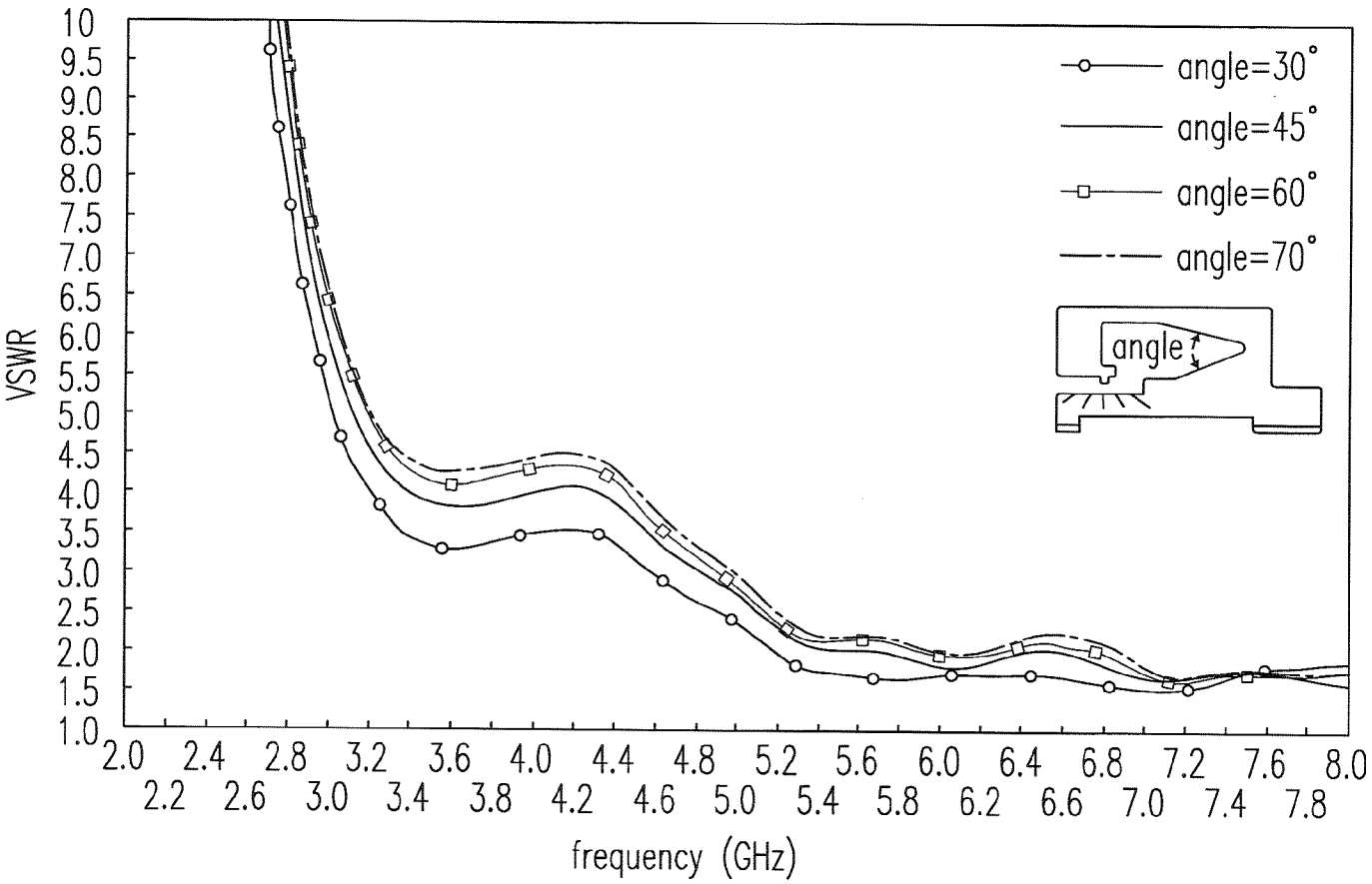
FIG. 3 shows the relationship between the variation of the angle θ and the VSWR according to the first embodiment of the present invention.
Figure 4B:
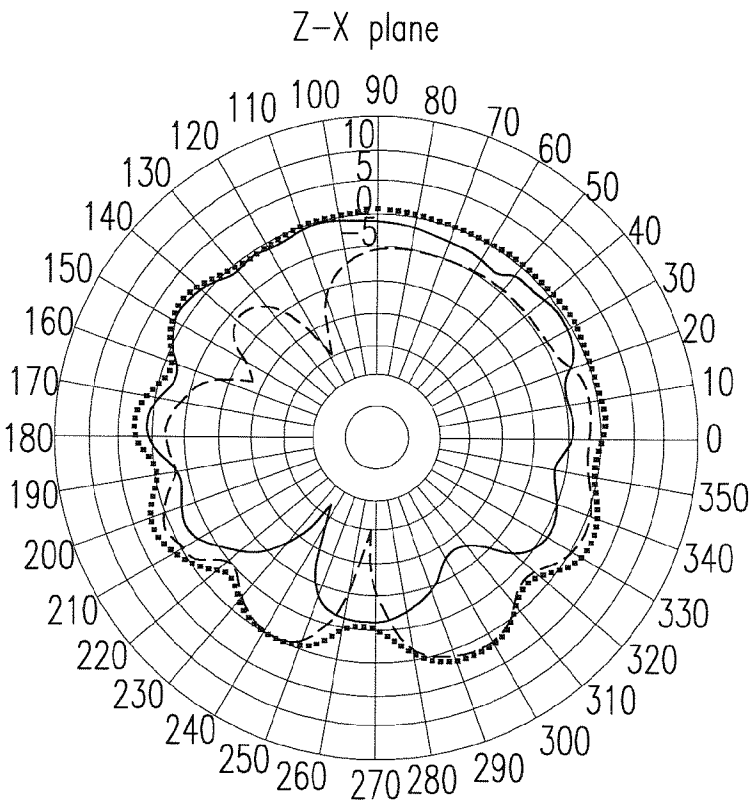
FIG. 4(*a*) is the radiation pattern of the antenna operating at the frequency f1 of 4.9 GHz in the Y-Z plane according to the first embodiment of the present invention.
Figure 4A:
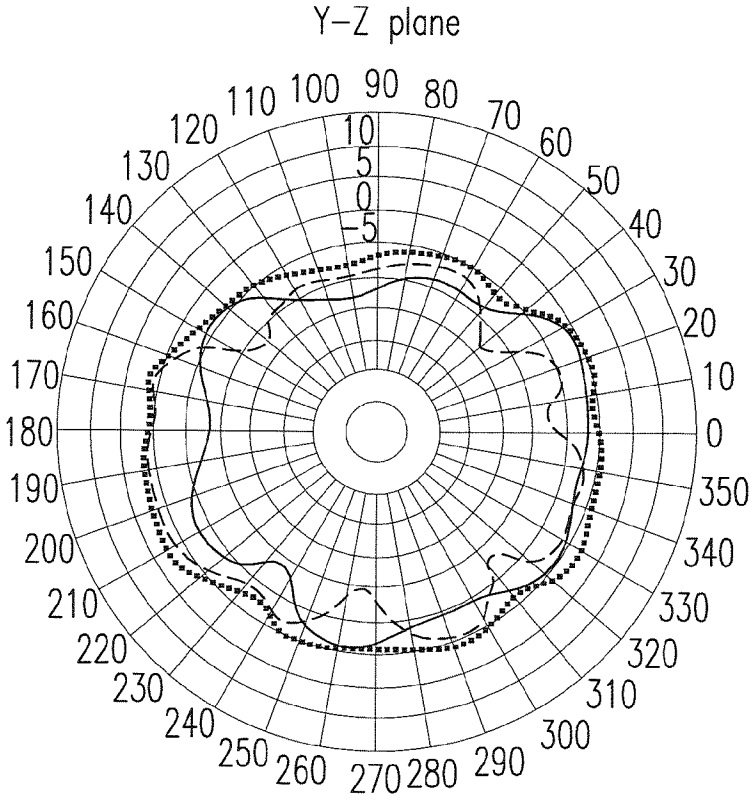
Figure 4C:
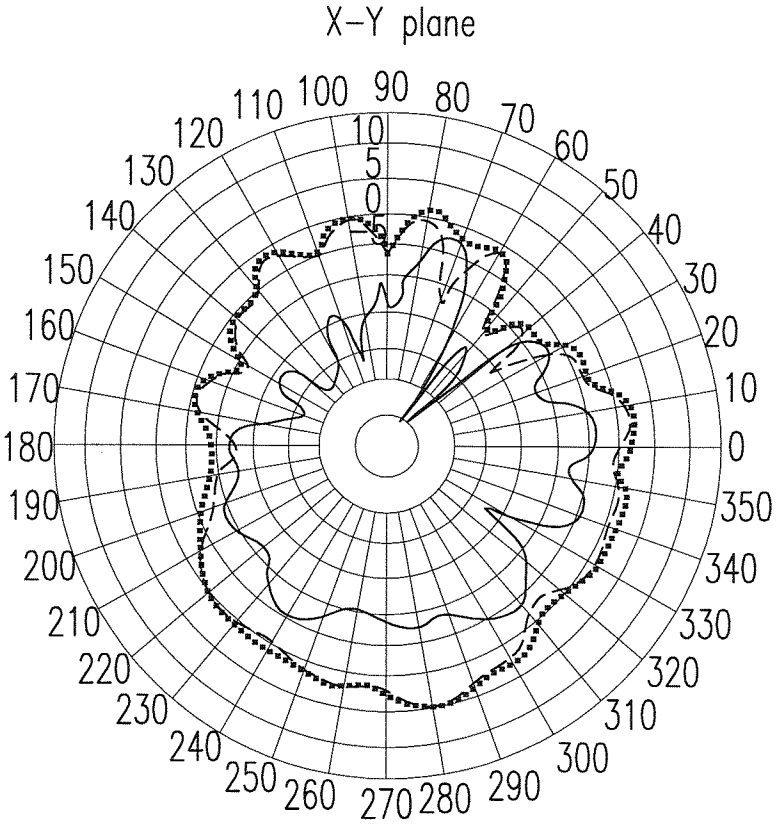
Figure 4D:
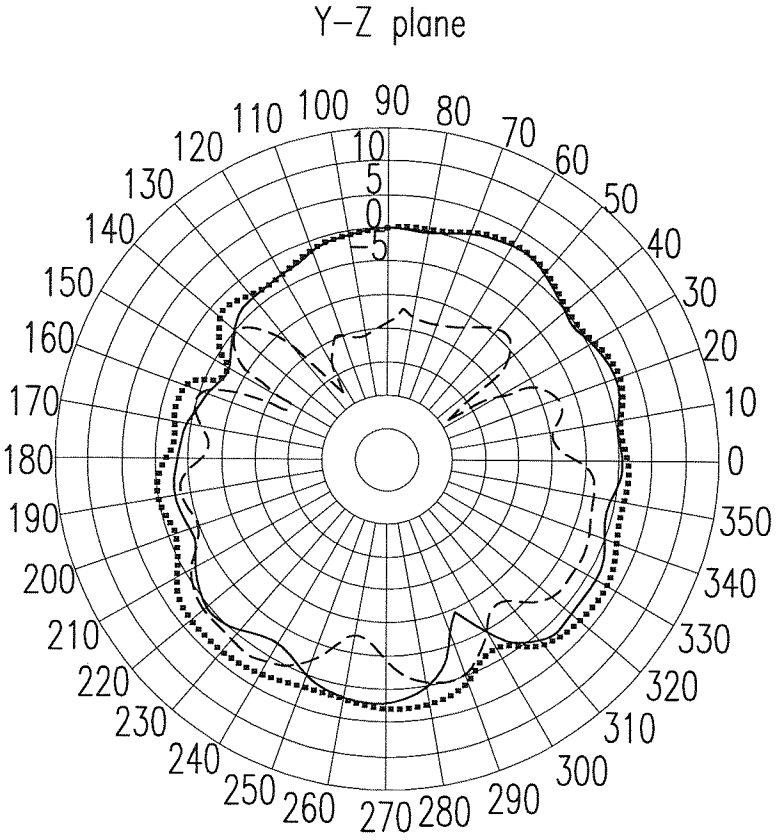
Figure 4E:
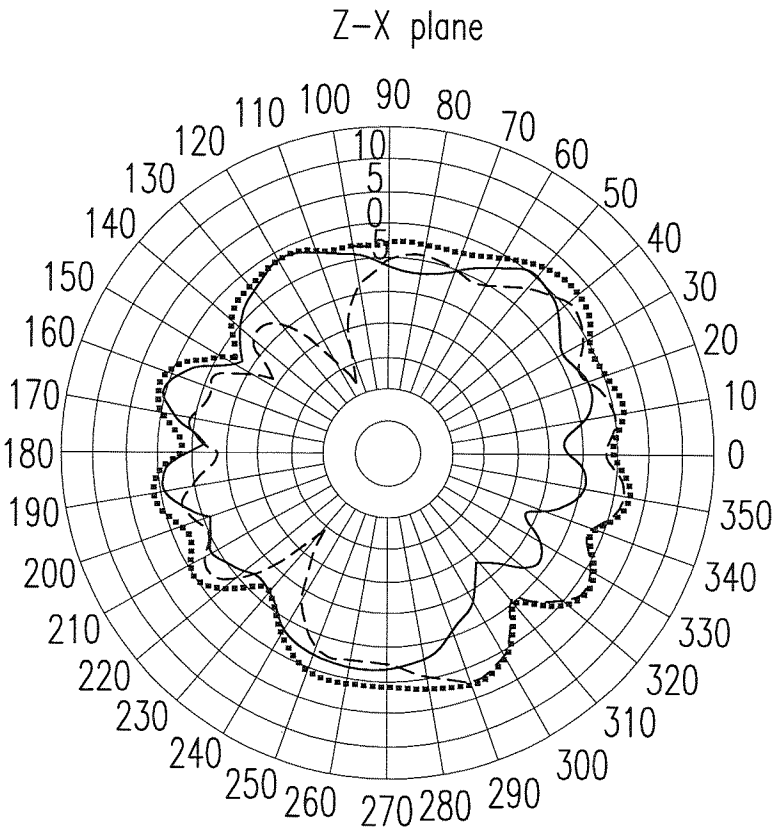
Figure 4F:
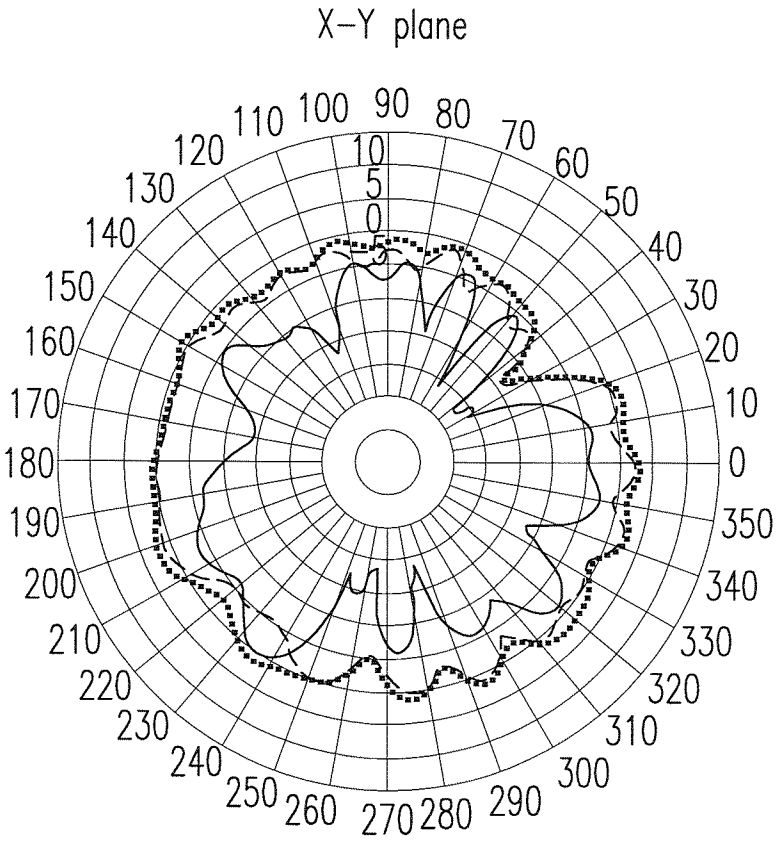

Please refer to FIG. 3, which shows the relationship between the variation of the angle θ and the VSWR according to the first embodiment of the present invention. FIG. 3 shows the simulation results through the software, wherein the transverse axle represents the frequency (the unit thereof is GHz), and the vertical axle represents the VSWR of the antenna 2. The antenna 2 has an impedance value related to the angle corner 2200. The impedance matching degree between the antenna 2 and the transmission line 24 will affect the VSWR of the antenna 2. Hence, when the angle θ of the angle corner 2200 changes, the VSWR of the antenna 2 changes. The closer the VSWR approaches 1, the better the impedance matching between the antenna 2 and the transmission line 24 is. Accordingly, the angle θ can be used to set the impedance value of the antenna 2 to enable the VSWR thereof to meet requirements.

In FIG. 3, the curve with circles shows the relationship between the VSWR of the antenna 2 and the frequency with the angle θ of 70°; the solid curve shows the relationship between the VSWR of the antenna 2 and the frequency with the angle θ of 45°; the curve with rectangles shows the relationship between the VSWR of the antenna 2 and the frequency with the angle θ of 60°; the dotted curve shows the relationship between the VSWR of the antenna 2 and the frequency with the angle θ of 30°. The frequency range with the VSWR below 2.0 represents the available frequency range. In FIG. 3, the frequency range with the VSWR below 2.0 is above 4.8 GHz, but the minimum value of the characteristic length of the antenna 2 needs to be considered. Therefore, in practical applications, the frequency range is about 4.8 GHz to 6 GHz. As shown in FIG. 3, when the angle θ is 30°, the VSWRs for the frequency range of 4.8 GHz to 6 GHz approach 1. This indicates that the impedance matching between the antenna 2 and the transmission line 24 at the angle θ of 30° is better than that at the angle θ of 45°, 60° or 70°. Accordingly, the angle θ of 30° is a better choice. That is to say, when the angle θ is 30°, 45°, 60° and 70° respectively, the impedance values of the antenna 2 are a first impedance, a second impedance, a third impedance and a fourth impedance respectively. The fourth impedance is larger than the third impedance, the third impedance is larger than the second impedance, and the second impedance is larger than the first impedance.

Please refer to FIG. 4(*a*), which is the radiation pattern of the antenna operating at the frequency f1 of 4.9 GHz in the Y-Z plane according to the first embodiment of the present invention. Please refer to FIG. 4(*b*), which is the radiation pattern of the antenna operating at the frequency f1 of 4.9 GHz in the Z-X plane according to the first embodiment of the present invention. Please refer to FIG. 4(*c*), which is the radiation pattern of the antenna operating at the frequency f1 of 4.9 GHz in the X-Y plane according to the first embodiment of the present invention. In FIGS. 4(*a*)-4(*c*), the respective radiation patterns of the antenna are all measured at the frequency of 4.9 GHz. In FIG. 4(*a*), the solid curve represents the antenna radiation gain formed by the antenna 2 in the Y-Z plane after the incidence of a test electromagnetic wave perpendicular to the ground (straight X direction). The dotted curve represents the antenna radiation gain formed by the antenna 2 in the Y-Z plane after the incidence of a test electromagnetic wave parallel with the ground (Z-axle direction). The curve with rectangles represents the antenna radiation gain formed by the antenna 2 in the Y-Z plane after the incidence of a test electromagnetic wave perpendicular to the ground (straight X direction) and a test electromagnetic wave parallel with the ground (Z-axle direction) respectively. In FIGS. 4(*b*) and 4(*c*), the solid curve, the dotted curve and the curve with rectangles have similar meanings to those in FIG. 4(*a*), but the antenna radiation gains formed are in the Z-X direction and the X-Y direction respectively.

Please refer to FIG. 4(*d*), which is the radiation pattern of the antenna operating at the frequency f1 of 5.875 GHz in the Y-Z plane according to the first embodiment of the present invention. Please refer to FIG. 4(*e*), which is the radiation pattern of the antenna operating at the frequency f1 of 5.875 GHz in the Z-X plane according to the first embodiment of the present invention. Please refer to FIG. 4(*f*), which is the radiation pattern of the antenna operating at the frequency f1 of 5.875 GHz in the X-Y plane according to the first embodiment of the present invention. In FIGS. 4(*d*)-4(*f*), the respective radiation patterns of the antenna are all measured at the frequency f1 of 5.875 GHz. In FIG. 4(*d*), the solid curve represents the antenna radiation gain formed by the antenna 2 in the Y-Z plane after the incidence of a test electromagnetic wave perpendicular to the ground (straight X direction). The dotted curve represents the antenna radiation gain formed by the antenna 2 in the Y-Z plane after the incidence of a test electromagnetic wave parallel with the ground (Z-axle direction). The curve with rectangles represents the antenna radiation gain formed by the antenna 2 in the Y-Z plane after the incidence of a test electromagnetic wave perpendicular to the ground (straight X direction) and a test electromagnetic wave parallel with the ground (Z-axle direction) respectively. In FIGS. 4(*e*) and 4(*f*), the solid curve, the dotted curve and the curve with rectangles have similar meanings to those in FIG. 4(*a*), but the antenna radiation gains formed are in the Z-X direction and the X-Y direction respectively.

Figure 5:
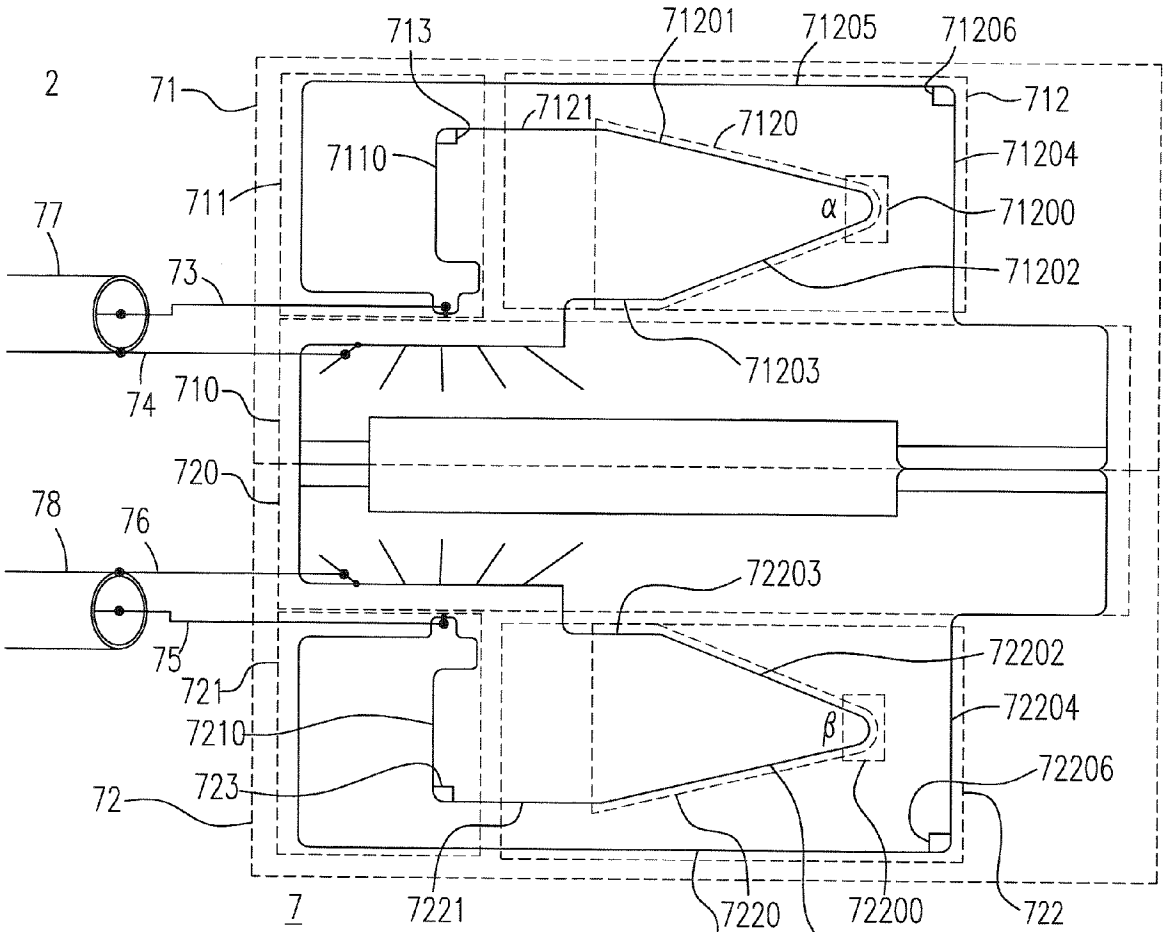
FIG. 5 shows an antenna according to a second embodiment of the present invention.

Please refer to FIG. 5, which shows an antenna according to a second embodiment of the present invention. The antenna 7 includes a first antenna unit 71 and a second antenna unit 72. The first antenna unit 71 has a first impedance value, and includes a first radiation element 712 and a first ground portion 710. The first radiation element 712 has a first hollow portion 7120 having a first angle corner 71200. The first radiation element 712 includes a first inner edge 71201, a second inner edge 71202, a third inner edge 71203, a first outer edge 71204, a second outer edge 71205 and a first included angle 71206. The first ground portion 710 is connected to the first radiation element 712.

The second antenna unit 72 has a second impedance value, and includes a second radiation element 722 and a second ground portion 720. The second radiation element 722 has a second hollow portion 7220 having a second angle corner 72200. The second radiation element 722 includes a fourth inner edge 72201, a fifth inner edge 72202, a sixth inner edge 72203, a third outer edge 72204, a fourth outer edge 72205 and a second included angle 72206. The second ground portion 720 is connected to the second radiation element 722. The first ground portion 710 is connected to the second ground portion 720. The first impedance value is set by the first angle corner 71200, and the second impedance value is set by the second angle corner 72200.

The first angle corner 71200 has a first angle, $\alpha$, and the second angle corner 72200 has a second angle $\beta$, wherein the first angle $\alpha$ can be different from the second angle $\beta$. Therefore, the first impedance value can be different from the second impedance value, and thus the respective suitable frequencies for the first antenna unit 71 and the second antenna unit 72 are different. That is to say, the antenna 7 can perform the reception and transmission at two different frequencies.

The first antenna unit 71 further includes a first feed portion 711 connected to the first radiation element 712. The edge 7110 of the first feed portion 711 and the edge 7121 of the first radiation element 712 form a third included angle 713. The second antenna unit 72 further includes a second feed portion 721 connected to the second radiation element 722. The edge 7210 of the second feed portion 721 and the edge 7221 of the second radiation element 722 form a fourth included angle 723. The first included angle 71206, the second included angle 72206, the third included angle 713 and the fourth included angle 723 are all 90°.

The first radiation element 71 and the second radiation element 72 both have a sheet structure being a V-shaped structure. The antenna 7 includes two rectangular loop-type structures respectively having a gap. The antenna structure 7 further includes a first signal conducting wire 73, a first ground conducting wire 74, a second signal conducting wire 75, a second ground conducting wire 76, a first transmission wire 77 and a second transmission wire 78. The first feed portion 711 is connected to the first transmission wire 77 via the first signal conducting wire 73 and the first ground conducting wire 74. The second feed portion 721 is connected to the second transmission wire 78 via the second signal conducting wire 75 and the second ground conducting wire 76.

Figure 6A:
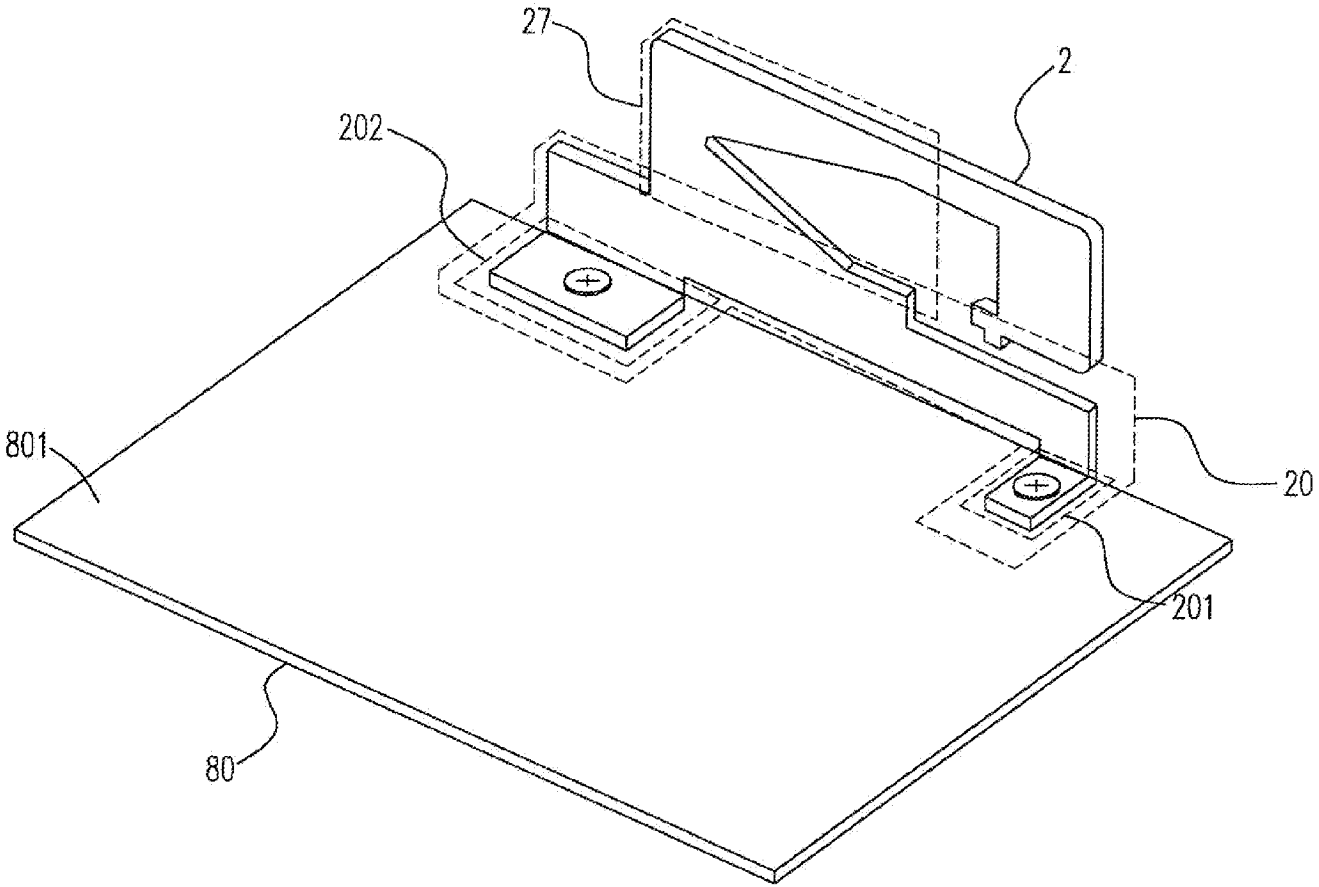
FIG. 6(*a*) shows the antenna connected to a substrate vertically according to the first embodiment of the present invention.
Figure 6B:
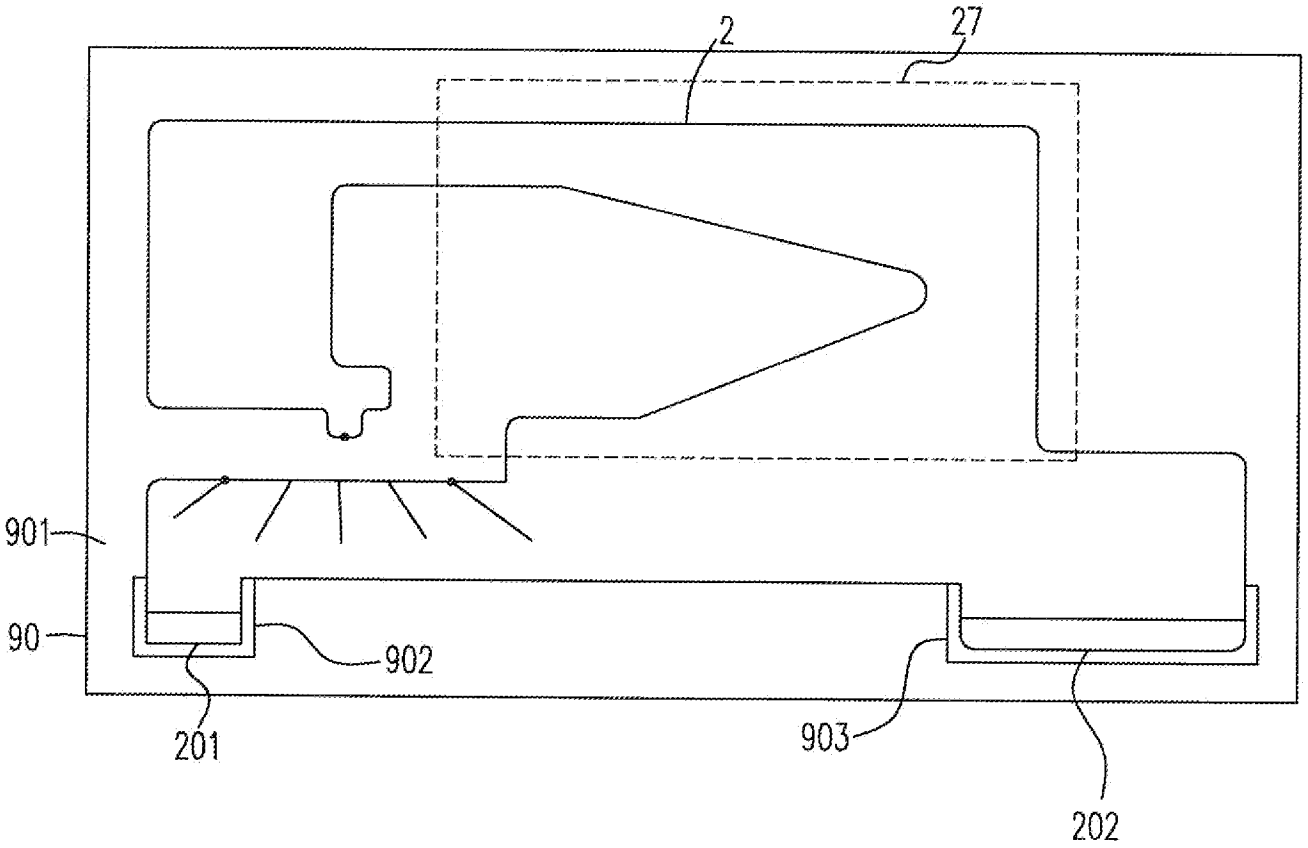

Please refer to FIG. 6(*a*), which shows the antenna connected to a substrate vertically according to the first embodiment of the present invention. The ground portion 20 of the antenna 2 further includes a first bending section 201 and a second bending section 202. The first bending section 201 and the second bending section 202 both have a screw hole (not shown), and the antenna 2 can be fixed on the substrate 80 via screws. The substrate 80 is a non-metal substrate, and has a surface 801 perpendicular to the sheet structure 27. Certainly, the antenna 2 can also be connected to the substrate 80 through insertion.

Please refer to FIG. 6(*b*), which shows the antenna connected to a substrate in parallel according to the first embodiment of the present invention. The substrate 90 is a non-metal substrate, and has a surface 901, a first through hole 902 and a second through hole 903. The antenna 2 is fixed on the substrate 90 by inserting the first bending section 201 into the first through hole 901 and inserting the second bending section 202 into the second through hole 903. The surface 901 is parallel with the sheet structure 27. Besides, the antenna 2 can also be disposed on the case and connected to the substrate 90 via the conducting wire.

EMBODIMENTS

1. An antenna, comprising:

a first antenna unit having a first impedance value and including:

a first radiation element having an edge and a first hollow portion having a first angle corner;

a first ground portion connected to the first radiation element; and a first feed portion connected to the first radiation element and having an edge, wherein the edge of the first feed portion and the edge of the first radiation element form a first included angle; and a second antenna unit having a second impedance value and including:

a second radiation element having an edge and a second hollow portion having a second angle corner;

a second ground portion connected to the second radiation element; and a second feed portion connected to the second radiation element and having an edge, wherein the edge of the second feed portion and the edge of the second radiation element form a second included angle, wherein the first ground portion is connected to the second ground portion, the first impedance value is set by the first angle corner, and the second impedance value is set by the second angle corner.

2. The antenna of Embodiment 1, wherein:

the first radiation element and the second radiation element both have a sheet structure being a V-shaped structure; and the antenna comprises two rectangular loop-type structures respectively having a gap.

3. The antenna of any one of Embodiments 1-2, further comprising a first signal conducting wire, a first ground conducting wire, a second signal conducting wire, a second ground conducting wire, a first transmission wire and a second transmission wire, wherein the first feed portion is connected to the first transmission wire via the first signal conducting wire and the first ground conducting wire, and the second feed portion is connected to the second transmission wire via the second signal conducting wire and the second ground conducting wire.

4. An antenna interacting with a signal having a frequency, comprising:

a radiation element having a hollow portion having an angle corner related to the frequency, and including:

a first inner edge;

a second inner edge, wherein the angle corner is formed by the first inner edge and the second inner edge;

a third inner edge connected to the second inner edge;

a first outer edge; and a second outer edge, wherein the first outer edge and the second outer edge form a first included angle.

5. The antenna of Embodiment 4, further comprising a feed portion having an edge and receiving the signal, wherein the radiation element further includes a first end portion and an inner edge, the feed portion is connected to the first end portion, and the edge of the feed portion and the inner edge of the radiation element form a second included angle.

6. The antenna of any one of Embodiments 4-5, wherein the antenna further comprises a ground portion connected to the radiation element and having a plurality of recesses, the radiation element further includes a second end portion connected to the ground portion, and the recesses are disposed at different positions of the ground portion for setting a characteristic length of the antenna to perform an action being one of sending and receiving the signal having the frequency.

7. The antenna of any one of Embodiments 4-6, wherein the ground portion is connected to the third inner edge.

8. The antenna of any one of Embodiments 4-7, wherein the first included angle and the second included angle are both 90°.

9. The antenna of any one of Embodiments 4-8, wherein the radiation element has a sheet structure being a V-shaped metal structure.

10. The antenna of any one of Embodiments 4-9, further comprising:

a non-metal substrate connected to the sheet structure and having a surface parallel with or perpendicular to the sheet structure.

11. The antenna of any one of Embodiments 4-10, wherein the antenna is a rectangular loop-type structure having a gap.

12. The antenna of any one of Embodiments 4-11, wherein the antenna has an impedance value related to the angle corner.

13. The antenna of any one of Embodiments 4-12, wherein the angle corner has an angle between 0° and 180°.

14. The antenna of any one of Embodiments 4-13, wherein:

when the angle is 180°, the hollow portion presents a first rectangle and the antenna structure has a first characteristic length;

when the angle is between 0° and 180°, the hollow portion presents a triangle and the antenna structure has a second characteristic length; and when the angle is 0°, the hollow portion presents a second rectangle and the antenna structure has a third characteristic length, wherein the first characteristic length is longer than the second characteristic length, and the second characteristic length is longer than the third characteristic length.

15. An antenna having an impedance value, comprising:

a radiation element having a hollow portion having an angle corner related to the impedance value, and including:

a first inner edge;

a second inner edge, wherein the angle corner is formed by the first inner edge and the second inner edge;

a third inner edge connected to the second inner edge;

a first outer edge; and a second outer edge, wherein the first outer edge and the second outer edge form a first included angle.

16. The antenna of Embodiment 15, wherein the radiation element further includes a first end portion and a second end portion, and the antenna further comprises:

a feed portion connected to the first end portion;

a ground portion connected to the second end portion and the third inner edge; and a substrate connected to the ground portion.

17. The antenna of any one of Embodiments 15-16, wherein the hollow portion has an edge, and the first inner edge is a part of the edge of the hollow portion.

18. The antenna of any one of Embodiments 15-17, wherein the hollow portion has an edge, and the second inner edge is a part of the edge of the hollow portion.

While the invention has been described in terms of what is presently considered to be the most practical and preferred embodiments, it is to be understood that the invention needs not be limited to the disclosed embodiments. On the contrary, it is intended to cover various modifications and similar arrangements included within the spirit and scope of the appended claims which are to be accorded with the broadest interpretation so as to encompass all such modifications and similar structures.

What is claimed is:

1. An antenna, comprising:

a first loop antenna unit including:

a first radiation element having a first inner edge, a second inner edge connected to the first inner edge, a third inner edge connected to the second inner edge, a first outer edge and a second outer edge connected to the first outer edge;

a first ground portion connected to the first radiation element, having a third outer edge, a fourth outer edge and a plurality of recesses, wherein the third outer edge is connected to the fourth outer edge, the fourth outer edge is connected to the third inner edge of the first radiation element, the plurality of recesses are non-parallel to and disconnected from one another, and the plurality of recesses are disposed at the third outer edge for setting a characteristic length of the antenna to perform an action being one of sending and receiving a signal having a frequency; and a first feed portion connected to the first radiation element and having an edge, wherein the edge of the first feed portion and an inner edge of the first radiation element form a first inclined angle; and a second loop antenna unit having a second impedance value, and including:

a second radiation element having an edge and a second hollow portion having a second angle corner;

a second ground portion connected to the second radiation element and having a plurality of recesses, wherein the plurality of recesses are non-parallel to and disconnected from one another and disposed at different positions of the second ground portion; and a second feed portion connected to the second radiation element and having an edge, wherein the edge of the second feed portion and the edge of the second radiation element form a second inclined angle, wherein the first ground portion is connected to the second ground portion.

2. An antenna as claimed in claim 1, wherein the first radiation element and the second radiation element both have a sheet structure being a V-shaped structure and the antenna comprises two rectangular loop structures respectively having a gap.

3. An antenna as claimed in claim 1, further comprising a first signal conducting wire, a first ground conducting wire, a second signal conducting wire, a second ground conducting wire, a first transmission wire and a second transmission wire, wherein the first feed portion is connected to the first transmission wire via the first signal conducting wire and the first ground conducting wire, and the second feed portion is connected to the second transmission wire via the second signal conducting wire and the second ground conducting wire.

4. A loop antenna interacting with a signal having a frequency, comprising:

a radiation element having a hollow portion having an angle corner related to the frequency, and including:

a first inner edge;

a second inner edge, wherein the angle corner is formed by the first inner edge and the second inner edge;

a third inner edge connected to the second inner edge;

a first end portion;

a fourth inner edge;

a first outer edge;

a second outer edge, wherein the first outer edge and the second outer edge form a first inclined angle;

a feed portion having an edge and connected to the radiation element, wherein the fourth inner edge is connected between the first inner edge and the edge of the feed portion; and a ground portion connected to the radiation element, having a third outer edge and a fourth outer edge and a plurality of recesses being non-parallel to and disconnected from one another, wherein the third outer edge is connected to the fourth outer edge, the fourth outer edge is connected to the third inner edge of the radiation element and the plurality of recesses are disposed at the third outer edge.

5. An antenna as claimed in claim 4, wherein the edge of the feed portion and the fourth inner edge of the radiation element form a second inclined angle.

6. An antenna as claimed in claim 4, wherein the ground portion is connected to the third inner edge.

7. An antenna as claimed in claim 5, wherein the first inclined angle and the second inclined angle are both 90°.

8. An antenna as claimed in claim 4, wherein the radiation element has a sheet structure being a V-shaped metal structure.

9. An antenna as claimed in claim 8, further comprising a non-metal substrate connected to the sheet structure and having a surface parallel with or perpendicular to the sheet structure.

10. An antenna as claimed in claim 4, wherein the antenna is a rectangular loop structure having a gap.

11. An antenna as claimed in claim 4, wherein the antenna has an impedance value related to the angle corner.

12. An antenna as claimed in claim 4, wherein the angle corner has an angle between 0° and 180° inclusive.

13. An antenna as claimed in claim 12, wherein:

when the angle is 180°, the hollow portion forms a first rectangle and the antenna has a first characteristic length;

when the angle is between 0° and 180°, the hollow portion forms a bullet shape and the antenna has a second characteristic length; and when the angle is 0°, the hollow portion forms a second rectangle and the antenna has a third characteristic length, wherein the first characteristic length is longer than the second characteristic length, and the second characteristic length is longer than the third characteristic length.

14. A loop antenna having an impedance value, comprising:

a radiation element having a hollow portion having an angle corner related to the impedance value, and including:

a first inner edge;

a second inner edge, wherein the angle corner is formed by the first inner edge and the second inner edge;

a third inner edge connected to the second inner edge;

a first outer edge;

a second outer edge, wherein the first outer edge and the second outer edge form a first inclined angle;

a ground portion connected to the radiation element, having a third outer edge and a fourth outer edge and a plurality of recesses that are non-parallel to and disconnected from one another, wherein the third outer edge is connected to the fourth outer edge, the fourth outer edge is connected to the third inner edge of the radiation element and the plurality of recesses are disposed at the third outer edge; and a feed portion connected to the radiation element.

15. An antenna as claimed in claim 14, wherein the radiation element further includes a first end portion and a second end portion, and wherein the feed portion is connected to the first end portion, the ground portion is connected to the second end portion and the third inner edge, and a substrate is connected to the ground portion.

16. An antenna as claimed in claim 14, wherein the hollow portion has an edge, and the first inner edge is a part of the edge of the hollow portion.

17. An antenna as claimed in claim 14, wherein the hollow portion has an edge, and the second inner edge is a part of the edge of the hollow portion.

* * * * *